US005557893A

United States Patent [19]

Bowls

[11] Patent Number: 5,557,893

[45] Date of Patent: Sep. 24, 1996

[54] ADJUSTABLE PITCH SPIRAL STAIRWAY KIT

[76] Inventor: George A. Bowls, 12315 Mukilteo Speedway, Lynnwood, Wash. 98037

[21] Appl. No.: 508,235

[22] Filed: Jul. 27, 1995

[51] Int. Cl.[6] ..... E04F 11/00

[52] U.S. Cl. ..... 52/187; 52/183; 256/64

[58] Field of Search ..... 52/183, 187, 690; 256/67

[56] References Cited

U.S. PATENT DOCUMENTS

| | | | |
|---|---|---|---|
| 684,451 | 10/1901 | Mowry . | |
| 3,306,586 | 7/1965 | Green | 256/67 X |
| 4,125,249 | 11/1978 | Zen | 256/67 |
| 4,138,094 | 2/1979 | Thir . | |
| 4,155,590 | 5/1979 | Cunningham . | |
| 4,272,061 | 6/1981 | Suckno . | |
| 4,373,310 | 2/1983 | Dean | 52/182 |
| 4,408,749 | 10/1983 | Zieg . | |
| 4,421,302 | 12/1983 | Grimm et al. . | |
| 4,505,456 | 3/1985 | Zieg . | |
| 4,928,930 | 5/1990 | Chung . | |
| 4,959,935 | 10/1990 | Stob | 52/183 |
| 5,056,628 | 10/1991 | Sapraski | 256/67 X |
| 5,131,197 | 7/1992 | Varga | 52/183 |

FOREIGN PATENT DOCUMENTS

| | | | |
|---|---|---|---|
| 1444734 | 8/1975 | European Pat. Off. | 52/184 |
| 1008216 | 10/1965 | New Zealand . | |

OTHER PUBLICATIONS

"Ornamental Iron, Spiral Stair–kits for the 90's" brochure, Ornamental Iron by George, Inc., Seattle, WA, 6 pp.

"Americana Classic" brochure, The American Ornamental Metal Co., Houston, TX, 8 pp.

*Primary Examiner*—Carl D. Friedman
*Assistant Examiner*—David J. Jersen
*Attorney, Agent, or Firm*—Christensen, O'Connor, Johnson & Kindness PLLC

[57] ABSTRACT

A spiral stairway (10) includes a center support pole(14), a plurality of steps (16), and an adjustable pitch railing assembly (12). The steps (16) are attached at a narrow end (22) to the center support pole (14) and at a peripheral end (24) to the railing assembly (12). The railing assembly (12) includes an upper railing (38), a lower railing (36), and a plurality of pickets (32). Each railing (36), (38) includes a continuous channel (54) formed along a length therein. Each picket (32) includes portions (62), preferably in the shape of a cylinder having a longitudinal axis transverse to the length of the picket (32). The railing assembly (12) further includes a plurality of inserts (34) having a length corresponding to the distance between pickets (32). The picket end portions (62) are engageable within corresponding partial circular cutouts formed within the inserts (34), and the combination is receivable in the railing channel (54). A fastener (74) fixedly secures the insert and picket end within the channel at a predefined angular orientation.

19 Claims, 4 Drawing Sheets

ADJUSTABLE PITCH SPIRAL STAIRWAY KIT

FIELD OF THE INVENTION

The present invention relates to spiral stairways, and more particularly to a spiral stairway kit having an adjustable pitch railing assembly.

BACKGROUND OF THE INVENTION

Spiral stairways are difficult to erect because the conditions of installation vary from one job site to another. This is because spiral stairways are often used in limited spaces, which require that the first and last steps meet predefined landings, and that all intermediate steps are equally spaced in both height and radial displacement from each other. This causes the radial spacing of the stair steps and the overall angle of inclination of the stairway to necessarily differ. Varying step locations about a center pole necessitates varying the positioning of accompanying pickets and railings.

It is precisely the above complexity in constructing a conventional spiral stairway that prompts most individuals to have them professionally built. The same complexity, however, exists for the manufacturer, because each installation must typically still be custom-made.

Therefore, what is needed is a spiral stairway having a railing assembly that may be easily and inexpensively manufactured; easily installed by both professionals and non-professionals; and easily adapted for a variety of installations. Such a spiral stairway and railing assembly would dramatically reduce or even eliminate the amount of unique tailoring that is currently required for conventional spiral stairways and railing assemblies.

U.S. Pat. No. 4,138,094 describes an adjustable railing assembly for straight, non-spiral stairways, where elongated inner retainers are secured in upper and lower rails. The inner retainers include a strip of material having equally spaced sockets therealong for receiving multiple baluster ends having cylindrical formations. Each retainer is T-shaped and is first loaded with balusters and is then slid into a rail. Alternatively, the retainer is rectangular and is positioned in a U-shaped rail, where a bolt secures the retainer in the rail. Either embodiment of this device has the disadvantage of being very difficult to use with spiral stairways, since either would require the manufacture of a long, curved retainer with sockets custom-made according to the particular spiral stairway specifications. The variations in angular orientation and spacing of the balusters in a straight stairway are not nearly as great as the potential angular orientation and picket spacing variations in a spiral stairway. This leads to precisely the custom attention the present invention seeks to avoid. The first embodiment additionally has the disadvantage of requiring the long curved T-shaped retainer to be slid longitudinally within a curved rail to load the baluster.

U.S. Pat. No. 4,928,930 describes an adjustable railing assembly where small individual retainers house cylindrical baluster ends, each retainer being slidably received in a slot formed in a rail. The device of this patent also requires custom routing of the slots and slot positions within a rail. This system would not be feasible for use in a spiral stairway kit because of the greater variety of positioning required for spiral stair installations.

It may be seen that what is needed is an adjustable spiral stairway kit having an adjustable railing assembly, where both the kit and the railing assembly are easy to manufacture, easy to adjust to fit a particular installation, and easy to install and maintain. The present invention provides such a device.

SUMMARY OF THE INVENTION

In accordance with the present invention, a spiral stairway having an adjustable pitch railing assembly is provided. The spiral stairway includes a center support pole, a plurality of steps, and an adjustable pitch railing assembly. The center support pole is secured to a ground level floor and extends vertically upward to a top level floor or ceiling. The steps of the spiral stairway start at a ground level lower landing and wind upwardly around the center support pole, to a top level upper landing. Each step is generally triangularly shaped with a narrow end attached to the center support pole and a peripheral end attached to the railing assembly.

In accordance with other aspects of this invention, the railing assembly includes an upper railing, a lower railing, a plurality of pickets, and a plurality of inserts. Each railing includes a longitudinal channel formed along a length therein. Each picket is oriented substantially vertically and includes first and second end portions receivable in the inserts. The preferred picket end portion shape is that of a short cylinder having a longitudinal axis transverse to the length of the picket. Each picket end portion is angularly adjustable within an insert to enable angular adjustment of each picket with respect to the upper and lower rails. The inserts, with end portions placed therein, are inserted into the longitudinal channel of a railing and secured at a particular location and angular orientation using a fastener.

In accordance with yet further aspects of this invention, the plurality of inserts generally come in one size that may be trimmed to a desired length. The preferred length is equal to the required distance between pickets.

In accordance with yet other aspects of this invention, a first preferred embodiment of the engagement of the first and second end portions of the pickets with the inserts is provided. Each inserts is a generally fiat, rectangular member having a cutout within which a picket end portion may be fitted. The longitudinal channel includes a slot within a tubular railing, the slot having a pair of opposed sidewalls that extend beyond the channel to form a pair of flanges. The insert with end portion therein is slid into the sidewalled channel and is preferably secured by a screw passing through the side wall flanges and through the cylinder of the picket end portion.

In accordance with still further aspects of this invention, a second preferred embodiment of the engagement of the first and second end portions of the pickets with the inserts is provided. Each insert includes rectangular first and second plates hingedly joined along an edge. A partial cutout on the inner surface of each plate provides a space within which a picket end portion may be fired when the plates are folded about the end portion. The longitudinal channel is a slot within a tubular railing, the slot extending entirely through the railing wall. The insert with end portion therein is slid into the slot and is preferably angularly secured by a screw passing through the insert plates and through the cylinder of the picket end portion. In addition, the second embodiment includes one or more projections formed on the outer surface of the insert plates for retaining the insert within a railing.

In accordance with still other aspects of this invention, an optional latch is provided on the insert for allowing the picket end portion to be inserted into the insert after the insert has been installed in a railing.

In accordance with further aspects of this invention, a spiral stairway kit is provided including the components of the spiral stairway and the adjustable railing assembly of the present invention.

As may be appreciated from the foregoing, the present invention provides an ideal spiral stairway with adjustable railing assembly. The adjustable length inserts allow for varying distances between pickets, and the rotatable picket ends give the ability to vary the angular orientation of the pickets relative to the railings. These features relieve the manufacturer of having to custom-make each railing assembly for separate installations, thereby reducing product variation. In addition, these features make it easy for the installer to adjust the picket orientations and spacings without complicated computations or specialized tools.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
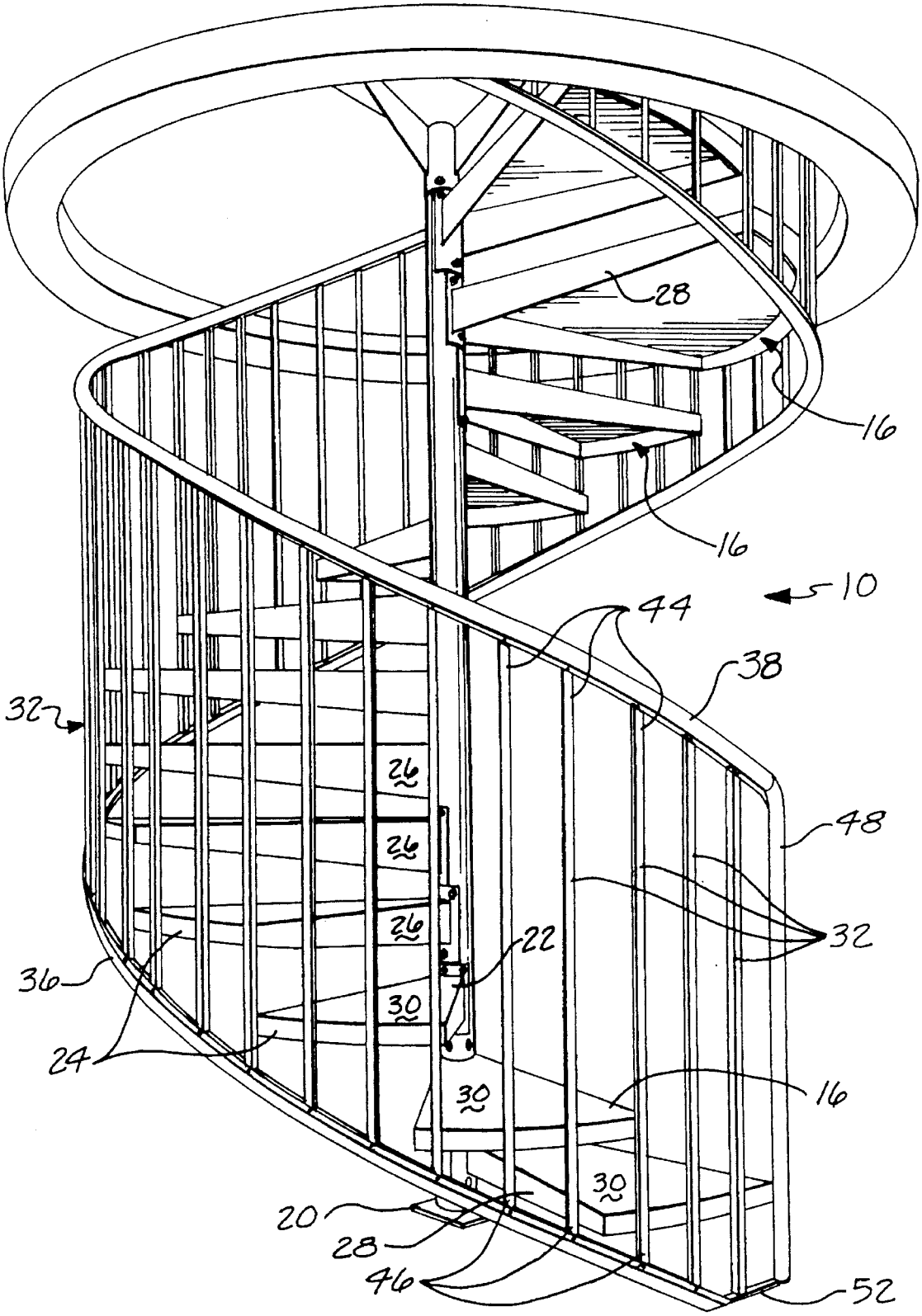
FIG. 1 is a perspective view of a spiral staircase including a railing assembly formed in accordance with the present invention.

FIG. 1 is a perspective view of a spiral stairway 10 including a railing assembly 12 formed in accordance with the present invention. The spiral stairway 10 includes a center support pole 14, a plurality of steps 16, and a railing assembly 12. The spiral stairway 10 is positioned on a ground level and extends vertically upward, through openings in one or more intermediate levels, to an opening in a top level. Users enter the spiral stairway 10 on the ground level at a lower landing, walk up the steps 16, and continue to an upper landing on the top level.

The center support pole 14 is oriented vertically, having an upper end and a lower end. The center support pole 14 is secured at its lower end to the floor of the ground level by use of a base plate 20. The base plate 20 is a flat metal plate having an annulus disposed on its upper surface for receiving the lower end of the center support pole 14, the axis of the annulus being in-line with the vertical axis of the center support pole 14. The upper end of the center support pole 14 preferably extends beyond the floor of the top level, and is anchored to the building structure at the floor of the upper landing or at an upper level ceiling, using techniques well known to those of skill in the construction arts.

Figure 3:
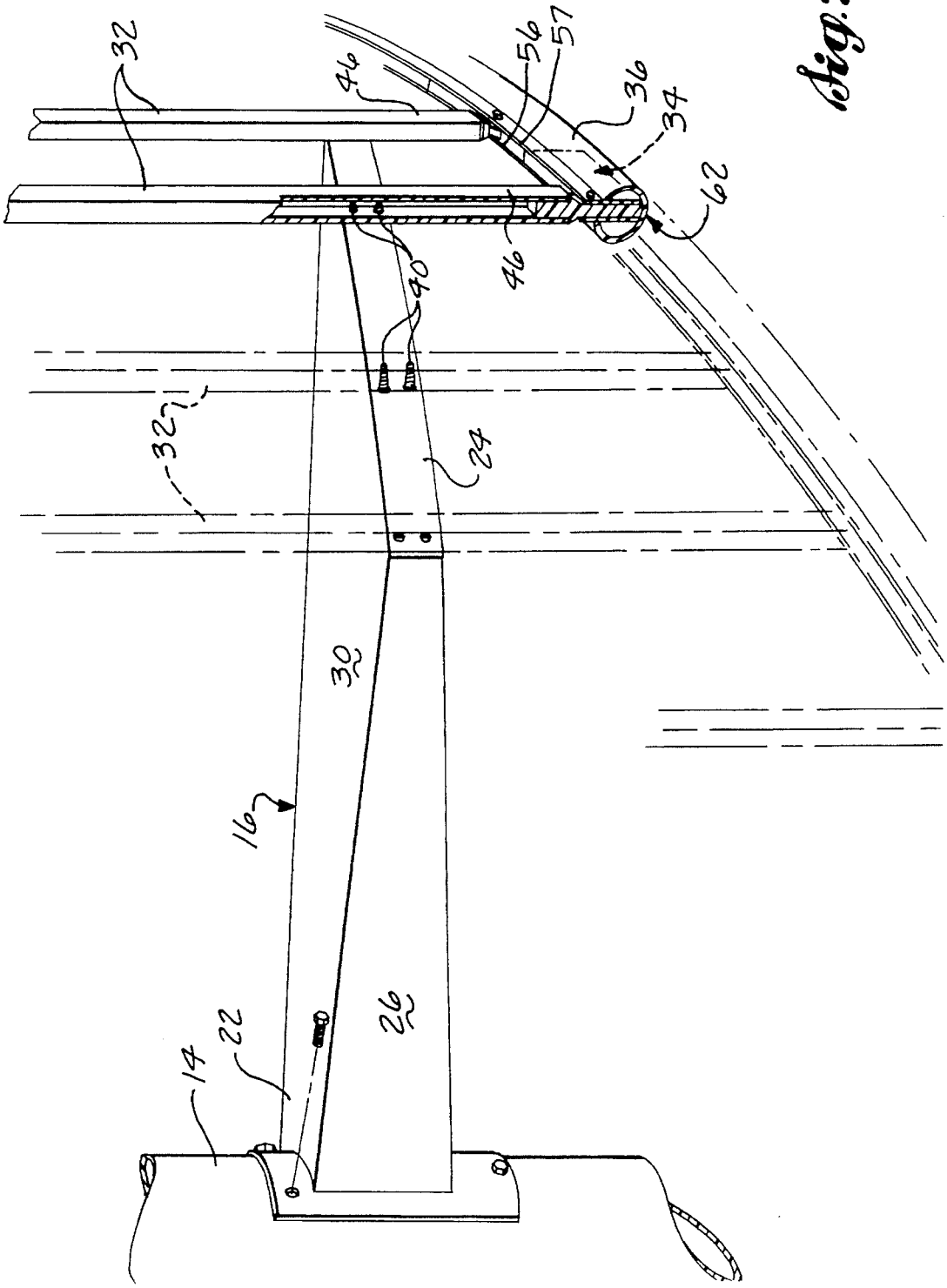
FIG. 3 is an isometric detailed view of the attachments of a spiral stairway step within the railing assembly of FIG. 1, with the railing assembly shown broken for clarity.

Each step 16 includes a narrow end 22, a peripheral end 24, a front face 26, a back face 28, and an upper surface 30. The entire step 16 is generally triangular in shape. The depth and width of each step 16 is of a predetermined size to be sufficient for the particular application. The narrow end 22 of each step 16 is secured radially to the center pole 14, with one step above the previous step and oriented radially such that the front face 26 is generally coplanar with the back face 28 of the previous step. FIG. 3 illustrates the bolting of the steps 16 to the center pole 14, but various attachment methods known to those skilled in the art of stairways may be used, e.g., screws, bolts, rivets, etc.

The peripheral end 24 of each step 16 is secured to a railing assembly 12 using any one of a number of known methods. FIG. 3 shows the use of a pair of screws 40. The railing assembly 12 includes a plurality of pickets 32 and a lower railing 36. In FIG. 1, the peripheral ends 24 of each step 16 are preferably attached to a plurality of pickets, such as four pickets, along four different locations on each peripheral end 24. The peripheral ends 24 of each step 16 may alternatively be attached to the lower railing 36, or to both the lower railing 36 and one or more pickets 32, or to just one or more, pickets 32.

Alternatively, the lower railing 36 may be omitted and the steps 16 may be attached only to one or more pickets 32. However, this construction is not preferred because of the loss of rigidity amongst the stair components and subsequent loss of structural strength.

The precise location and number of peripheral end step attachments may vary greatly, depending on local construction code, the space available for constructing the stairway 10 and the user's preferences regarding step 16 size and number of pickets 32.

The railing assembly 12 of the present invention generally includes an upper railing 38, a lower railing 36, a plurality of pickets 32, and a plurality of inserts 34. The upper and lower railings 38, 36 wind upwardly about a constant radius of the center support pole 14 from the lower landing to the upper landing.

Each picket 32 is oriented substantially vertically and includes an upper end 44 and a lower end 46. The ends 44, 46 of the pickets are held within the inserts 34 which are then secured to the upper and lower railings 38, 36. This attachment is described in detail below. The pickets 32 may be the same in size, strength, and appearance; or, they may vary. The precise number of pickets 32 will depend on the local code, the aesthetic tastes of the user, and the amount of support required for a particular installation. The kit of the present invention allows selection of from two to four or more pickets per step, as desired.

At both the lower and upper landings, an end post 48 is preferably used to mark the beginning and ending of the railings and the stairway 10, respectively. A lower end post 48 is secured to the floor of the ground level, extends vertically up therefrom, and is secured to an end of the upper railing 38. The upper end post (not shown) is attached at the upper landing in a like manner. The ends of the lower railing 36 may attach to the end posts 48; or, as shown in FIG. 1, to a connector 52; or directly to the floor. The connector 52 is generally a thin, flat, rectangular metal piece that extends between the lower railing 36 and an end post.

Figure 2:
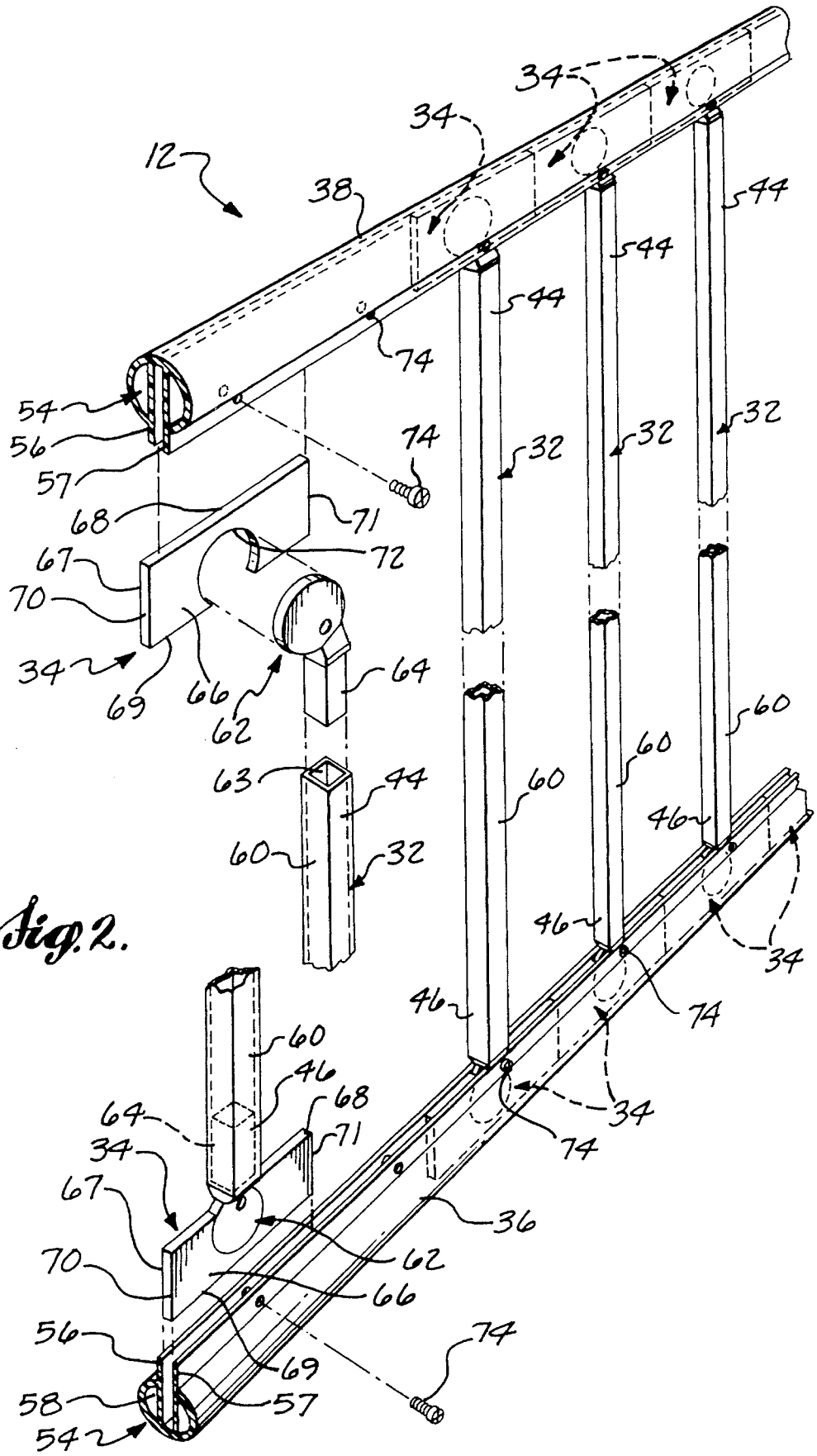
FIG. 2 is a perspective schematic of the railing assembly used in the spiral stairway of FIG. 1, with the internal structure of the railing assembly shown in phantom and one picket assembly shown prior to insertion into the railing.

The connection of the pickets 32 to the railings 36, 38 is a key feature of the present invention. In a first preferred embodiment, shown in FIGS. 2 and 3, the lower railing 36 defines a longitudinal channel 54 along an upper surface. Similarly, the upper railing 38 defines a longitudinal channel 54 along a lower surface. The channel 54 has vertical sidewalls 56, 57 for receiving and guiding an insert 34. The channel 54 of FIG. 2 shows one version of the vertical sidewalls 56, 57 that includes a pair of opposed flanges winding along a slot 58 in a tubular railing and extending from the inside surface of the tubular railing to beyond the outer-most opposed surface of the tubular railing. Each flange bisects the interior of the railing 36, 38 chordwise. The flanges resemble a pair of lips within which one or more inserts 34 may be slid between. The railings flanges may be formed of any structurally suitable material, e.g., sturdy plastic, wood, metal, etc. In the preferred embodiment, the railings 36, 38 are constructed of PVC piping, as this material is easily formed in a spiral, easily cut, and relatively inexpensively manufactured. The flanges and slot 58 may be integrally formed with the railing tubing as a one piece extrusion.

The pickets 32 each include an elongate middle member 60 and detachable end portions 62, as shown in FIG. 2. The middle member 60 is an elongate rod, ornamented according to the tastes of the user. The end portions 62 are preferably in the shape of a cylinder having a longitudinal axis transverse to the length of the picket 32, as shown in FIG. 2.

The cylindrical end portions 62 are cocked relative to the middle member 60. Preferably, a chord drawn through the center of the end portion 62 intersects the longitudinal axis of the middle member 60 at the top of the middle member 60 to define an angle ranging from greater than 0 degrees to less than 90 degrees, preferably from 30 to 60 degrees, and most preferably approximately 45 degrees.

The end portions 62 further include an attachment member for attaching to the middle member 60. The attachment member will vary in type and configuration according to the method of attachment selected. Various methods are known and any appropriate one may be used. FIG. 2 shows a tubular middle member 60 having a square cross sectional shape and open ends that form female inlets 63. The end portion attachment member is a male insert 64 capable of fitting into the female inlet 63, to be secured by riveting, bolting or welding, for example. The pickets 32 may be formed of any structurally suitable material, the preferred material being sturdy plastic.

Each of the plurality of inserts 34 is a generally flat, rectangular piece having: two faces 66, 67; two long edges 68, 69; two short edges 70, 71; and a circular cutout 72 formed along the middle of one of its long edges. The cutout 72 is an arc of between 200 and 290 degrees, extending entirely through the insert 34, from one face to the other. The cutout 72 functions as a socket within which the cylindrical end portions 62 of the pickets 32 may be inserted. The cutout 72 is shaped to closely match the shape of the picket end portions 62. A picket end portion 62 is fired into the cutout 72 with the picket end attachment member 64 extending beyond the insert 34. It is preferred that the arc of the cutout 72 be greater than 180 degrees, and preferably no less than 200 degrees, to avoid the-picket end portion 62 from falling out of the cutout 72. It is also preferred that the are be no more than 290 degrees, to avoid restricting the angular positions available for orienting the pickets. The insert 34, with the picket end portion 62 engaged therein, is next inserted into the longitudinal channel 54 of a railing 36, 38. The insertion may be accomplished by sliding the insert longitudinally along the channel, or by sliding the insert normally into the channel, i.e., inserted in a radial direction relative to the longitudinal axis of the railing 36, 38.

In the preferred first embodiment, the insert 34 is sized to fit within the channel 54 such that the end portion attachment member 64 is adjacent the outer-most edges of the lips of the channel 54. A small mount of room, however, is necessary, in order to rotate the end portion 62 to its required position. Once the end portion 62 is correctly positioned, a fastener 74 is used to hold it in place. The fastener 74 of the preferred embodiment is a small screw inserted in a hole bored entirely through the lips of the channel 54 and the picket end portion 62. An equally effective method is to insert a shorter screw through just one lip of the channel 54, pressing it into the picket end portion 62 but not entirely through the end portion 62. In this manner, the screw works to both hold the picket end portion 62 at a desired angle and to retain the insert 34 and end portion 62 within the channel 54.

The plurality of inserts 34 each preferably have a length set equal to the desired distance between pickets 32. The shorter the insert 34 is, the easier it is to slide the insert 34 radially into and longitudinally along the channel 54. The use of a plurality of inserts gives the longitudinal series of inserts a degree of collective flexibility, allowing the inserts to follow the curve of the railings. If longer inserts are to be used for wider picket spacing, it is preferred that a flexible material be used to form the inserts, such as ultra high density polyethylene or other thermoplastic. Each insert, thus, can bend individually to follow the curve of the railings. In the preferred embodiment, the inserts 34 are capable of being cut using ordinary utility shears to adjust picket spacing.

Figure 4:
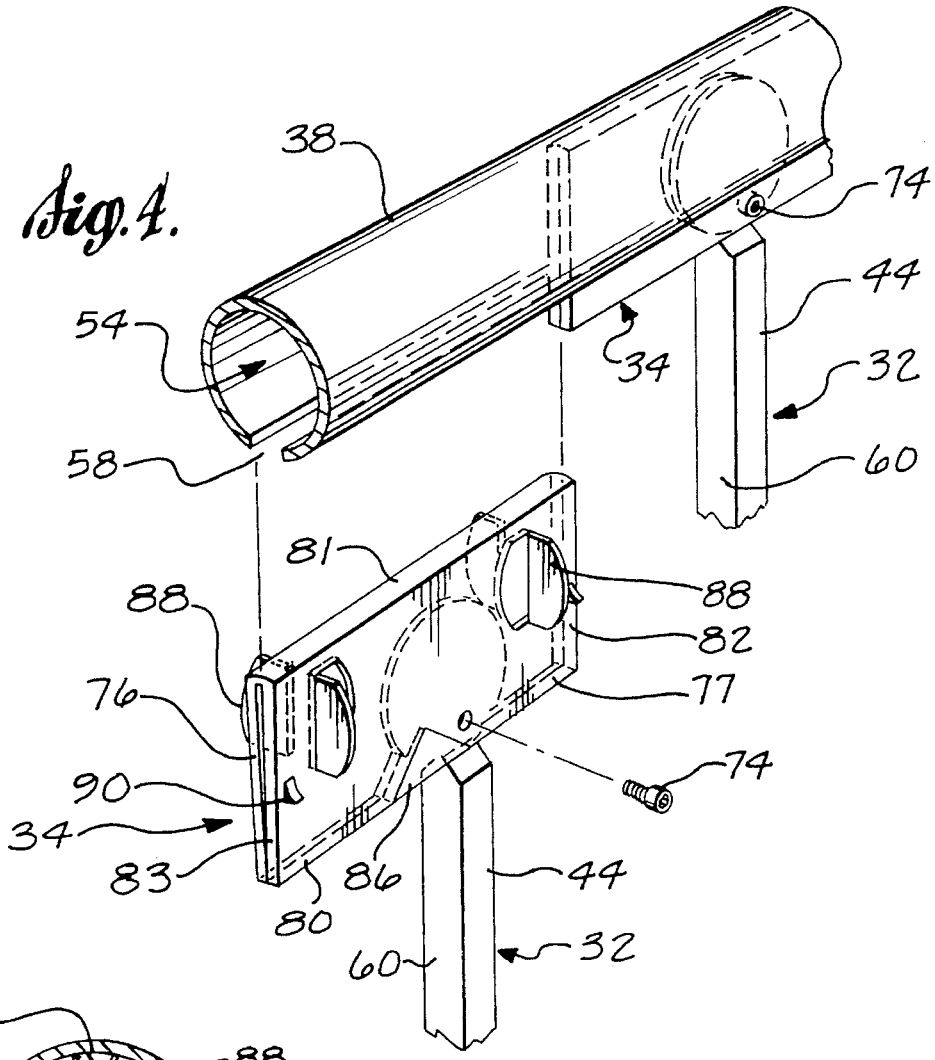
FIG. 4 is a partial phantom isometric detailed view of a second preferred embodiment of a railing assembly formed in accordance with the present invention, with one picket shown installed within the railing and a second picket shown prior to being installed within the railing.
Figure 5:
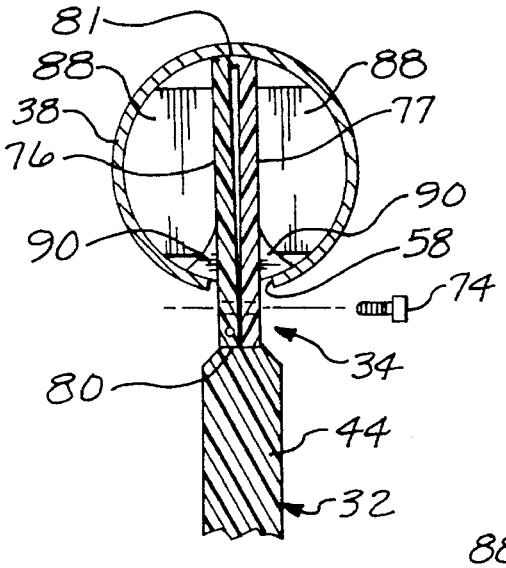
FIG. 5 is a cross sectional end view of a portion of the railing assembly shown in FIG. 4 taken along the longitudinal axis of the installed picket.
Figure 6:
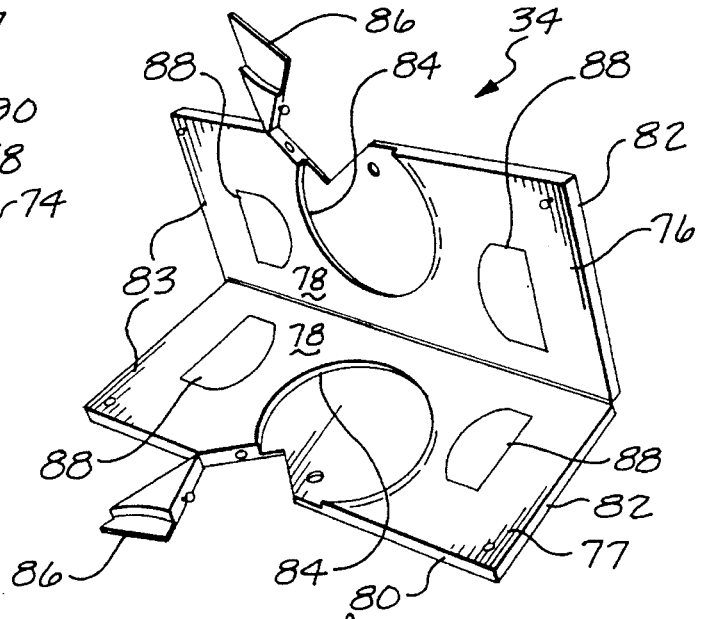
FIG. 6 is an isometric schematic of the insert of FIG. 4.

In a second preferred embodiment, shown in FIGS. 4, 5 and 6, the lower railing 36 defines a longitudinal channel 54 along an upper surface, and the upper railing defines a channel 54 along a lower surface. The channel 54 is basically a longitudinal slot 58 in a tubular railing, that extends to from the outer surface of the railing to the hollow inner surface. The slot 58 accommodates and guides the inserts 34. The railings 36, 38 may be formed of any structurally suitable material, e.g., plastic, wood, metal, etc. In the preferred embodiment, the railings are constructed of PVC piping, as this material is easily formed in a spiral, easily cut, and relatively inexpensively manufactured.

The pickets 32 of the second preferred embodiment are the same as described above. The inserts 34, though, include two opposed plates 76, 77, hingedly joined at one long edge. Once folded, the two opposed plates 76, 77 form a generally flat, rectangular piece having: an inner face 78; outer face 79; two long edges 80, 81; and two short edges 82, 83. A partial circular cutout 84, 86 is formed in each of the opposed plates 76, 77. Each cutout 84, 86 defines an arc of between 200 and 290 degrees extending partially through a plate 76, 77, from an inner face 78 towards an outer face 79. The cutout 84 functions as a socket within which the cylindrical end portions 62 of the pickets 32 may be inserted. The cutout 84 is shaped to closely match the shape of the picket end portions 62. A picket end portion 62 is placed in a cutout 84 of one of the opposed plates 76, and the other opposed plate 77 is folded around the end portion 62. The picket end portion 62 is held within the insert 34 such that the picket end attachment member 64 extends beyond the insert 34. It is suggested that the are of the cutout 72 be no less than 200 degrees, as then the picket end portion 62 will tend to fall out of the cutout 72. It is also suggested that the arc be no more than 290 degrees, as then it will tend to restrict the angular positions available for orienting the pickets. The insert 34, with the picket end portion 62 engaged therein, is next inserted into the longitudinal channel 54 of a railing 36, 38. The insertion may be accomplished by sliding the insert longitudinally along the channel, or by sliding the insert normally into the channel.

In an alternative version of the second embodiment, each opposed plate 76, 77 of the insert 34 additionally includes a latch 86 formed of a portion of the plate near the intersection of the cutout 84 with the long edge 80. The latch 86 is hingedly attached to the remaining portion of the plate 76, 77. The latch 86 allows the picket end portion 62 to be inserted into the cutout 84 of the insert 34 after the insert 34 has been positioned into the channel 54. When the latch 86 is open, the end portion 62 may be inserted into the cutout 84. The latch 86 is then rotated to its closed position adjacent the remaining portion of the insert 34. The latch 86 may be held in place using any of a number of known methods, including a positive snap arrangement (as shown in FIG. 6), a screw (not shown), adhesive (not shown), etc.

In the second embodiment, the insert 34 is sized to fit within the channel 54 such that the end portion attachment member 64 is adjacent the outer surface of the railing 36, 38. A small mount of room is necessary, though, in order to rotate the end portion 62 to its required position. Once the end portion 62 is correctly positioned, a fastener 74 is used to hold it is its required angular position. The fastener 74 is a small screw inserted in a hold bored entirely through the insert plates 76, 77 and the picket end portion 62. An equally effective method is to insert a shorter screw through just one plate of the insert 34, pressing it into the picket end portion 62 but not entirely through the end portion 62. In this manner, the screw works to hold the picket end portion 62 at a desired angle.

To retain the insert 34 within the slotted tubular railing, a projection is provided on the outer faces of the insert. Two versions of projections are shown in FIGS. 4 and 5. The first version is a flap 88. The second version is a nub 90. Both versions are basically rigid protrusions extending normally from the outer faces of the insert 34. These projections 88, 90 function to keep the insert 34 from falling out of the channel slot 58 and sliding along the channel 54 within the slot 58.

For an individual to assemble the spiral stairway 10 of the present invention, the general process is as follows. First the center support pole 14 is erected. Then the steps 16 are attached to the center support pole 14. The end posts 48 are attached to the first and last steps and the inserts 34 are cut to their required length. The picket end portions 62 are fitted into the inserts 34. The inserts 34, with end portions therein, are inserted into the channels 54 of the upper and lower railings 38, 36. Alternatively, if the embodiment of an insert 34 having a latch is used, the inserts 34 may be first inserted into the channels 54 and the picket end portions may then be placed within each insert. In either case, the inserts 34 are located one after another within the channels 54. The lower railing 36 is attached to the end posts. The picket middle members 60 are attached to their end portions. The upper railing with inserts 34 and end portions are attached to the middle members 60. The upper railing is secured to the end posts. The angular positions of the pickets 32 are secured and the peripheral end 24 of the steps 16 are attached to the pickets 32 and/or lower railing 36.

While the preferred embodiment of the invention has been illustrated and described, it will be appreciated that various changes can be made therein without departing from the spirit and scope of the invention. In particular, the present invention may be easily used for stairways that are not spiral stairways.

The embodiments of the invention in which an exclusive property or privilege is claimed are defined as follows:

1. A spiral stairway comprising:

(a) a plurality of steps, each step having an inner end and a peripheral end;

(b) an upper railing defining a continuous longitudinal channel;

(c) a plurality of pickets each having a first end portion and a second end portion;

(d) a plurality of elongate inserts, each having a length equal to a predetermined spacing between pickets, the first end portion of each picket being engageable with an insert, the first end portions of the pickets and their engaged respective inserts being receivable within the upper railing channel with the inserts arranged in a longitudinal array to locate the end portions of the pickets at the predetermined spacing;

(e) means for securing the inserts and engaged first picket end portions within the upper railing channel at a desired longitudinal position; and (f) a center support pole, wherein the inner end of each step is secured to the center support pole and the peripheral end of each step is coupled to at least one corresponding picket.

2. The spiral stairway of claim 1, further composing:

(a) a lower railing defining a longitudinal channel;

(b) a second plurality of elongate inserts, each having a length equal to the predetermined picket spacing, the second end portion of each picket being engageable with an insert, the inserts and engaged second picket ends being received within the lower rail channel; and (c) means for securing the inserts and engaged second picket ends within the lower railing channel.

3. The spiral stairway of claim 2, wherein the pickets are adjustable in angular orientation relative to the first and second railings, the means for securing the inserts and engaged first and second picket ends within the upper and lower railing channels serving to secure the pickets in a selected angular orientation.

4. The spiral stairway according to claim 1, wherein the channels of the upper and lower railings are capable of receiving the plurality of inserts and picket end portions at multiple locations along the length of the rails.

5. The spiral stairway according to claim 1, wherein the first railing comprises a flexible coiled plastic tube.

6. The spiral stairway according to claim 1, further comprising a projection formed on a side of the insert and projecting laterally therefrom for securing the insert with engaged picket end therein within the longitudinal channel at a particular location.

7. An adjustable railing assembly, comprising:

(a) a first railing defining a longitudinal channel;

(b) a plurality of pickets, each having an end portion;

(c) a plurality of elongate inserts, each insert having a length equal to a predetermined distance between pickets, the end portion of each picket being engageable with a corresponding insert, the picket end portions and engaged inserts being receivable within the first railing channel with the inserts arranged end to end to locate the end portions of the pickets at the predetermined distance; and (d) means for securing the inserts and engaged picket ends within the first railing channel.

8. An adjustable railing assembly according to claim 7, wherein the channel is capable of receiving the plurality of inserts and picket end portions at multiple locations along the length of the first railing.

9. An adjustable railing assembly according to claim 7, wherein the first railing includes a cylindrical tube having a tube wall and the longitudinal channel includes a slot through the tube wall.

10. An adjustable railing assembly according to claim 9, wherein the first railing further includes a pair of opposed flanges defining sides of the channel slot and extending from a base of the slot defined by an inside surface of the tubular first railing to project beyond an opposed outer surface of the tubular first railing.

11. An adjustable railing assembly according to claim 7, wherein the first railing comprises a flexible coiled plastic tube.

12. An adjustable railing assembly according to claim 7, wherein each picket defines a second end portion, further including a second railing parallel to the first railing defining a second longitudinal channel and a second plurality of inserts capable of engaging the second picket end portions, the second railing being capable of receiving the second plurality of inserts with engaged second end portion disposed therein.

13. An adjustable railing assembly according to claim 7, further including a projection formed on a side of each insert and projecting laterally therefrom for securing the insert with engaged picket end therein within the first railing channel at a selected location.

14. An adjustable railing assembly according to claim 7, wherein the inserts each comprise a flat, substantially rectangular member having a partially circular cutout for receiving a correspondingly contoured picket end portion, the picket end portion being adjustable in angular orientation relative to the rail by rotating the picket end portion within the insert cutout.

15. An adjustable railing assembly according to claim 7, wherein the inserts comprise first and second opposed plates hingedly joined at one edge, the inserts including a partial circular cutout formed in each of the opposed plates capable of receiving the correspondingly contoured picket end portion by folding the opposed plates about the end portion.

16. A adjustable railing assembly according to claim 7, wherein the insert includes a latch disposed on the insert near the cutout for allowing insertion of the picket end portion into the insert after the insert has been inserted into the channel.

17. A spiral stair kit including:

(a) a plurality of steps, each step having an inner end and a peripheral end;

(b) an upper railing and a lower railing, each defining a continuous longitudinal channel;

(c) a plurality of pickets each having a first end portion and a second end portion;

(d) a plurality of elongated inserts, each having a length equal to a predetermined spacing between pickets, the first and second end portions each picket being engageable with an insert, the first and second end portions and their respective inserts being receivable within the upper and lower railing channels with the inserts arranged in a longitudinal array to locate the end portions of the pickets at the predetermined spacing;

(e) means for securing the inserts and engaged picket end portions within the corresponding railing channels; and (f) a center support pole, wherein the inner end of each step is securable to the center support pole and the peripheral end of each step is securable to one or both of the plurality of pickets and lower railing.

18. An adjustable railing assembly, comprising:

(a) a railing defining a longitudinal channel;

(b) a plurality of pickets, each having an end portion;

(c) at least one insert for engaging at least one picket end portion, each insert having a length equal to a predetermined spacing between pickets, the channel including an opening of sufficient width to permit radial insertion of the insert with engaged picket end therein; and (d) means for securing the inserts and engaged picket ends within the railing channel at a selected angular orientation.

19. An adjustable railing assembly according to claim 18, wherein the channel is capable of receiving the plurality of inserts and picket end portions at multiple locations along the length of the first railing.

* * * * *